US009304489B2

(12) United States Patent
Orikasa

(10) Patent No.: US 9,304,489 B2
(45) Date of Patent: Apr. 5, 2016

(54) IMAGE FORMING APPARATUS

(71) Applicant: Takamichi Orikasa, Kanagawa (JP)

(72) Inventor: Takamichi Orikasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/747,104

(22) Filed: Jun. 23, 2015

(65) Prior Publication Data

US 2016/0004217 A1 Jan. 7, 2016

(30) Foreign Application Priority Data

Jul. 7, 2014 (JP) ..... 2014-139494

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 15/0258
USPC ..... 399/92, 93
See application file for complete search history.

(56) References Cited

U.S. PATENT DOCUMENTS 3,936,184 A * 2/1976 Tanaka ..... G03G 15/0258 399/93
5,291,247 A * 3/1994 DeCecca ..... G03G 15/0258 399/92
5,376,994 A * 12/1994 Mama ..... G03G 15/011 399/93
2006/0269306 A1 11/2006 Shimizu
2014/0079431 A1 3/2014 Orikasa et al.

FOREIGN PATENT DOCUMENTS

| | | | |
|---|---|---|---|
| EP | 1727000 | A2 | 11/2006 |
| JP | H01-277255 | A | 11/1989 |
| JP | H03-029975 | | 2/1991 |
| JP | H05-216321 | A | 8/1993 |
| JP | 2003-066675 | | 3/2003 |
| JP | 2008-076777 | A | 4/2008 |
| JP | 2012-155210 | A | 8/2012 |
| JP | 2014-077975 | | 5/2014 |

OTHER PUBLICATIONS

Extended European Search Report dated Nov. 27, 2015 issued in corresponding European Application No. 15173907.5.

* cited by examiner

*Primary Examiner* — Susan Lee
(74) *Attorney, Agent, or Firm* — Harness, Dickey & Pierce, P.L.C.

(57) ABSTRACT

An image forming apparatus includes: an image bearer; a charging unit configured to charge a surface of the image bearer by causing a discharging member to discharge; a latent image forming unit configured to form a latent image on the surface of the image bearer charged by the charging unit; a developing unit configured to develop the latent image formed on the surface of the image bearer into a toner image with developer containing toner; an airflow generating unit configured to generate an airflow inside the image forming apparatus such that the airflow passes through at least the charging unit; an image-area-ratio information acquiring unit configured to acquire information on an image area ratio of the toner image; and a control unit configured to control the airflow generating unit so as to change a flow velocity of the airflow in accordance with the image area ratio.

8 Claims, 12 Drawing Sheets

IMAGE FORMING APPARATUS

CROSS-REFERENCE TO RELATED APPLICATIONS

The present application claims priority to and incorporates by reference the entire contents of Japanese Patent Application No. 2014-139494 filed in Japan on Jul. 7, 2014.

BACKGROUND OF THE INVENTION

1. Field of the Invention

The present invention relates to an image forming apparatus, such as a printer, a facsimile machine, or a copier.

2. Description of the Related Art

In an electrophotography image forming apparatus, a charging device uniformly charges a surface of a photoconductor, an exposure device exposes the surface of the photoconductor based on image information to form a latent image, and a developing device develops the latent image by attaching toner in developer to the latent image. A toner image formed on the surface of the photoconductor by the developing is transferred to a recording material directly or via an intermediate transfer medium, and the toner image transferred to the recording material is fixed to the recording material by a fixing device. A cleaning device removes, from the surface of the photoconductor, residual toner remaining on the surface of the photoconductor after the transfer.

In an image forming apparatus described in Japanese Laid-open Patent Publication No. 2014-77975, a corona charger is used as the charging device. The corona charger generates a corona discharge by a strong electric field between a corona discharge electrode to which a high voltage is applied and a grid electrode facing the corona discharge electrode. The surface of the photoconductor is uniformly charged by using charges generated by the corona discharge.

An electrostatic dust collection action acts on the surface of a discharging member, such as the corona discharge electrode, so that toner floating inside the image forming apparatus is likely to adhere to the surface of the discharging member. Therefore, with use of the charging device over a long time, toner is accumulated on the surface of the discharging member. Consequently, a discharge distribution becomes uneven and a local discharge or the like may occur, resulting in a non-uniform discharge.

In the image forming apparatus described in Japanese Laid-open Patent Publication No. 2014-77975, an airflow is generated inside the image forming apparatus by an exhaust fan such that the airflow passes through the charging device in order to discharge scattered toner from the charging device and reduce toner attached to the surface of the discharging member. Therefore, it is possible to prevent toner from being accumulated on the surface of the discharging member with time, and to prevent occurrence of a non-uniform discharge.

Most of the toner removed from the surface of the photoconductor by the cleaning device is collected by the cleaning device. However, some of the toner is not collected by the cleaning device, and floats, as scattered toner, inside the image forming apparatus.

When a toner image, such as a photograph image, with a high image area ratio is formed on the surface of the photoconductor, the amount of toner attached to the surface of the photoconductor increases, and the amount of toner that is scattered without being collected from the surface of the photoconductor by the cleaning device tends to increase accordingly. Therefore, if the scattered toner is not efficiently discharged from the cleaning device by the airflow, a large amount of toner adheres to the surface of the discharging member and a non-uniform discharge is likely to occur, so that a non-uniform charge occurs on the surface of the photoconductor. This causes image density unevenness resulting in an abnormal image.

Therefore, if the flow velocity of the airflow is increased by rotating the exhaust fan at a high speed by supposing a case in which a large amount of toner is scattered, the scattered toner can efficiently be discharged from the charging device by the airflow, and the amount of toner attached to the surface of the discharging member can be reduced.

However, if the flow velocity of the airflow is increased by rotating the exhaust fan always at a high speed, even when a toner image, such as a photograph image, with a high image area ratio is not formed on the surface of the photoconductor and the amount of scattered toner is small, the exhaust fan is rotated at a higher speed than needed. Therefore, an extra noise, such as the sound of the rotating exhaust fan or the sound of the discharged airflow, may be generated, for example.

Even in a charging device of a roller charging system, which charges the surface of the photoconductor by a discharge of a charging roller serving as the discharging member, the same issues as described above occur.

In view of the above, there is a need to provide an image forming apparatus capable of preventing occurrence of an extra noise and preventing an abnormal image from being formed due to a non-uniform discharge.

SUMMARY OF THE INVENTION

It is an object of the present invention to at least partially solve the problems in the conventional technology.

An image forming apparatus includes: an image bearer; a charging unit configured to charge a surface of the image bearer by causing a discharging member to discharge; a latent image forming unit configured to form a latent image on the surface of the image bearer charged by the charging unit; a developing unit configured to develop the latent image formed on the surface of the image bearer into a toner image with developer containing toner; an airflow generating unit configured to generate an airflow inside the image forming apparatus such that the airflow passes through at least the charging unit; an image-area-ratio information acquiring unit configured to acquire information on an image area ratio of the toner image; and a control unit configured to control the airflow generating unit so as to change a flow velocity of the airflow in accordance with the image area ratio.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
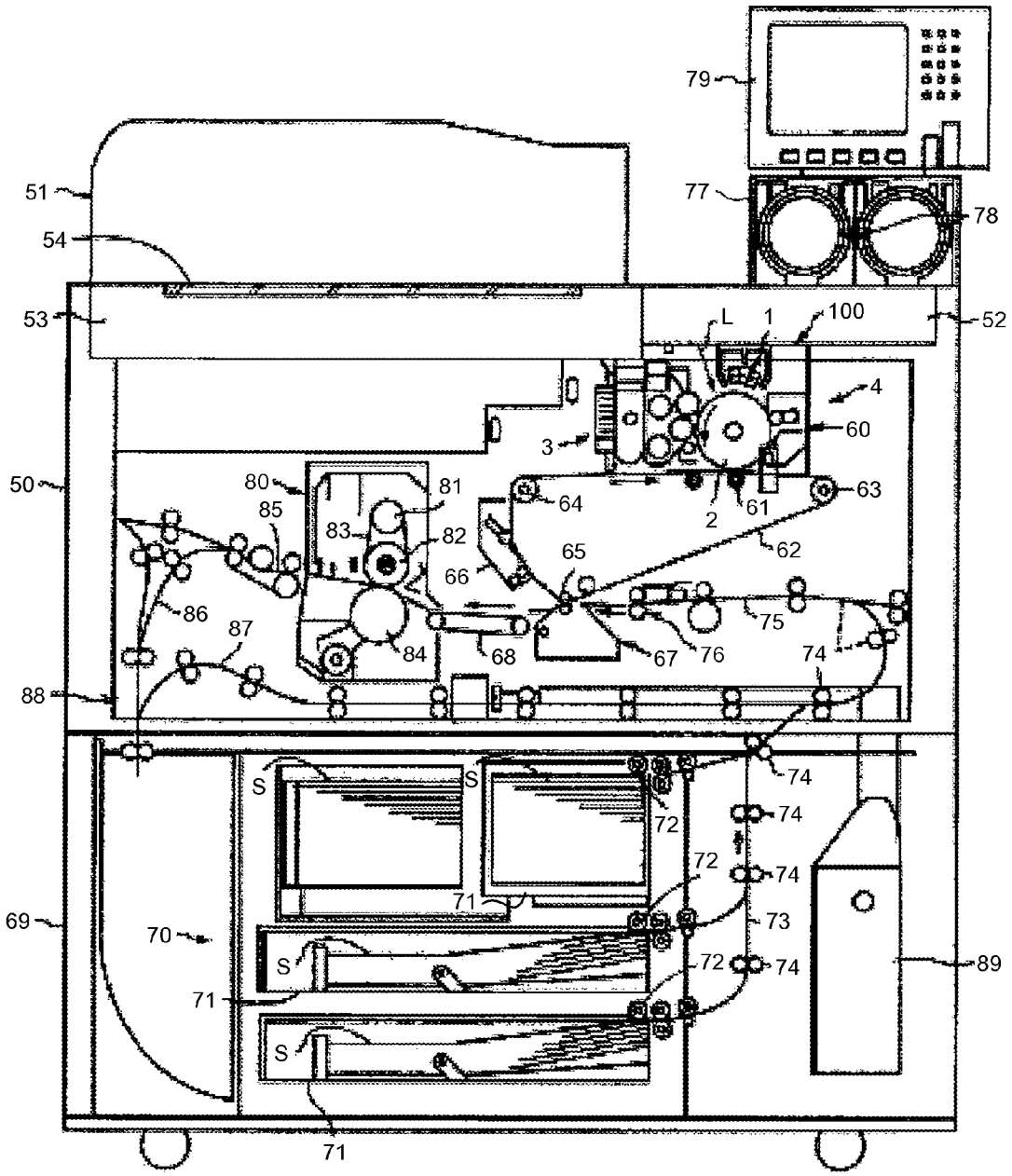
FIG. 2 is an entire configuration diagram of an image forming apparatus including a charging device according to an embodiment.

The entire configuration of an image forming apparatus including a charging device according to an embodiment of the present invention will be described with reference to FIG. 2. FIG. 2 is an entire configuration diagram of the image forming apparatus including the charging device according to the embodiment.

In FIG. 2, a reference sign 50 denotes an apparatus main-body of an electrophotography image forming apparatus (hereinafter, referred to as an "image forming apparatus body"). In the image forming apparatus body 50, a drum-shaped photoconductor drum 2 as an example of an image bearer is arranged. Around the photoconductor drum 2, a charging device 100, a developing device 3, a primary transfer roller 61, and a cleaning device 60 are arranged in this order in a rotation direction of the photoconductor drum 2 (counterclockwise indicated by an arrow).

Figure 3:
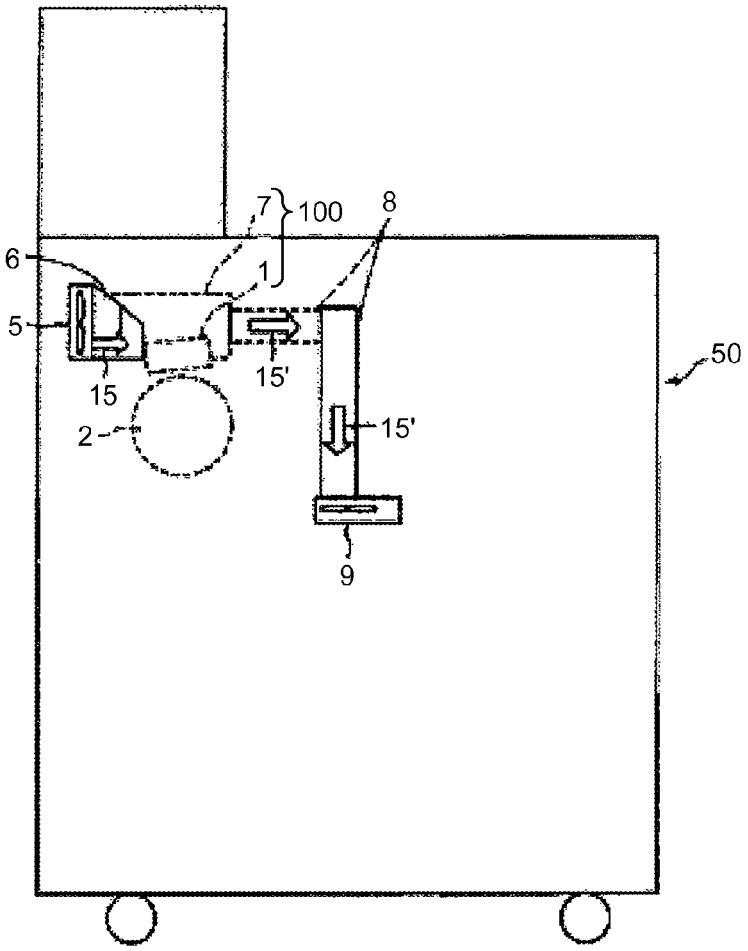
FIG. 3 is a rear view of main parts of the image forming apparatus illustrated in FIG. 2, including the intake/exhaust fans and a duct path.

An image formation unit 4 mainly includes the photoconductor drum 2, the charging device 100, an exposure device to be described later, and the developing device 3. The primary transfer roller 61 is arranged below the photoconductor drum 2 across an intermediate transfer belt 62. The charging device 100 includes an electric charger 1 that is also referred to as a charging unit, and a charging duct 7 as illustrated in FIG. 3 to be described later, for example.

A laser writing device 52 serving as the exposure device is arranged above the above-descried devices. The laser writing device 52 includes a well-known component (not illustrated) such as a scanning optical system including a light source such as a laser diode, a rotary polygon mirror for scanning, a polygon motor, and a scanning lens including an fθ lens.

A document reading device 53 is arranged in the upper part of the image forming apparatus body 50. The document reading device 53 includes well-known components (not illustrated) including a light source, a plurality of mirrors, an imaging forming lens, and an image sensor such as a charge coupled device (CCD).

An intermediate transfer device is arranged in the vicinity below the photoconductor drum 2. In the intermediate transfer device, the endless intermediate transfer belt 62 is wound around a supporting roller 63, a supporting roller 64, and a secondary transfer roller 65 so as to be able to move and rotate in a direction of an arrow (clockwise) in the figure.

One of the supporting roller 63, the supporting roller 64, and the secondary transfer roller 65 is configured as a driving roller, and the others are configured as driven rollers. The intermediate transfer belt 62 has a function to be applied with a reverse-bias (+) voltage and transfer/convey a toner image attached to a latent image formed on the surface of the photoconductor drum. The secondary transfer roller 65 presses the intermediate transfer belt 62 against a secondary transfer device 67, so that a secondary transfer nip portion is formed. The secondary transfer device 67 applies a secondary transfer bias to the secondary transfer roller.

A belt-type conveying device 68 and a fixing device 80 are arranged at the left of the secondary transfer device 67 in the figure. The fixing device 80 includes a heating roller 81 with a built-in heater, a fixing roller 82, an endless fixing belt 83 wound around the heating roller 81 and the fixing roller 82, and a pressing roller 84 pressed against the fixing roller 82 from below via the fixing belt 83.

A duplex unit 88 is arranged in the lower part of the image forming apparatus body 50. The duplex unit 88 includes a paper re-feeding path 87 communicating with a paper feeding path 75 extended to the secondary transfer device 67. In the duplex unit 88, a reverse path 86 branches from the middle of a paper ejection path 85 extended from an exit of the fixing device 80. The paper feeding path 75 is connected to a manual feeding path that is extended from a manual feeding tray (not illustrated) in the horizontal direction.

A contact glass 54 is placed on an upper surface of the image forming apparatus body 50. An automatic document feeder (ADF) 51 is mounted in an openable and closable manner on the image forming apparatus body 50 so as to cover the contact glass 54.

A toner replenishing device 77 for mounting toner bottles 78 is arranged at the right of the ADF 51. An operation panel 79 for operating the image forming apparatus is provided at an upper portion of the toner replenishing device 77. The two toner bottles 78 are mounted on the toner replenishing device 77, and the toner replenishing device 77 supplies toner from the toner bottles 78 to the developing device 3. When the toner in one of the tonner bottles 78 is consumed, the toner supply is switched to the other tonner bottle 78.

The developing device 3 includes a toner density detection sensor (not illustrated), which is provided on a lower wall of a developer container containing developer and serves as a toner density detecting unit including a magnetic permeability sensor to detect a toner density of the developer and output a voltage corresponding to a detection result. A control unit (not illustrated) drives the toner replenishing device 77 if needed to supply an appropriate amount of toner to the developer container on the basis of a voltage value output from the toner density detection sensor. Therefore, the toner density of the developer, which has been reduced along with the developing, can be returned to a predetermined density set in advance.

The image forming apparatus body 50 is mounted on a paper feeding table 69. In the paper feeding table 69, multiple paper feeding cassettes 71 (three cassettes in the embodiment), in which sheets S as an example of sheet-shaped recording media are housed and stacked, are equipped as a paper feeding unit 70. The paper feeding cassettes 71 are provided with respective paper feeding rollers 72. The paper feeding roller 72 is designed to introduce the sheet S sent out to a conveying path 73 connected to the paper feeding path 75. A plurality of pairs of conveying rollers 74 are arranged in the conveying path 73.

A waste tonner tank 89 for accumulating and discarding used toner is arranged at the right of the paper feeding table 69 in the figure.

When a copy is made using a laser copier configured as described above, a document is set on the ADF 51, or the ADF 51 is opened to set the document directly on the contact glass 54. If a start switch (not illustrated) is pressed, the document reading device 53 reads, pixel by pixel, the document conveyed onto the contact glass 54 by driving the ADf 51, or the document already set on the contact glass 54.

The paper feeding roller 72 of the appropriate paper feeding cassette 71 in the paper feeding table 69 is rotated in accordance with the document reading operation, and the sheet S is sent out from the corresponding paper feeding cassette 71. The sheet S sent out to the conveying path 73 is conveyed by the conveying rollers 74, put onto the paper feeding path 75, made to abut against a registration roller 76, and stopped. The registration roller 76 is subsequently rotated in synchronization with a timing of rotation of a toner image transferred onto the intermediate transfer belt 62, and the sheet is fed into a nip portion between the intermediate transfer belt 62 and the secondary transfer roller 65.

When the start switch provided on the operation panel 79 is pressed, the photoconductor drum 2 rotates counterclockwise in the figure and at the same time the intermediate transfer belt 62 runs/rotates in the direction of an arrow in the figure. With the rotation of the photoconductor drum 2, the electric charger 1 in the charging device 100 uniformly charges the surface of the photoconductor drum 2. Subsequently, laser light L is applied in accordance with the read content read by the above-described document reading device 53, and the laser writing device 52 performs writing to form a latent image on the surface of the photoconductor drum 2. Thereafter, the developing device 3 develops the latent image with toner in the developer to form a visible image as a toner image.

The toner image formed on the surface of the photoconductor drum 2 is primarily transferred to the intermediate transfer belt 62 by the primary transfer roller 61. The toner image transferred to the intermediate transfer belt 62 is collectively transferred by the secondary transfer roller 65 of the secondary transfer device 67 to the sheet fed to the nip portion between the intermediate transfer belt 62 and the secondary transfer device 67.

The surface of the photoconductor drum after image transfer is cleaned by removing residual toner by the cleaning device 60, neutralized by a neutralizing device (not illustrated), and prepared for next image formation. Further, the surface of the intermediate transfer belt after image transfer is cleaned by removing residual toner and paper powder by a belt cleaning device 66, and prepared for next image formation.

Meanwhile, the sheet after image transfer is conveyed by the belt-type conveying device 68 and put in the fixing device 80. The fixing roller 82 and the pressing roller 84 apply heat and pressure to the sheet via the fixing belt 83 to fix the transfer image (toner image). The sheet is subsequently ejected onto, for example, a paper ejection tray (not illustrated) attached to the image forming apparatus body 50 through the paper ejection path 85.

When the image forming apparatus forms an image also on the back side of the sheet S, after forming an image on one side, the sheet S is put into the duplex unit 88 through the reverse path 86, turned upside down, conveyed through the paper re-feeding path 87, and guided to the paper feeding path 75. The sheet S is then sent again to the nip portion between the intermediate transfer belt 62 and the secondary transfer roller 65, where a toner image which has been formed on the photoconductor drum 2 and primarily transferred to the intermediate transfer belt 62, is secondarily transferred to the back side of the sheet S. Thereafter, the sheet S is ejected onto, for example, the paper ejection tray (not illustrated).

Figure 4:
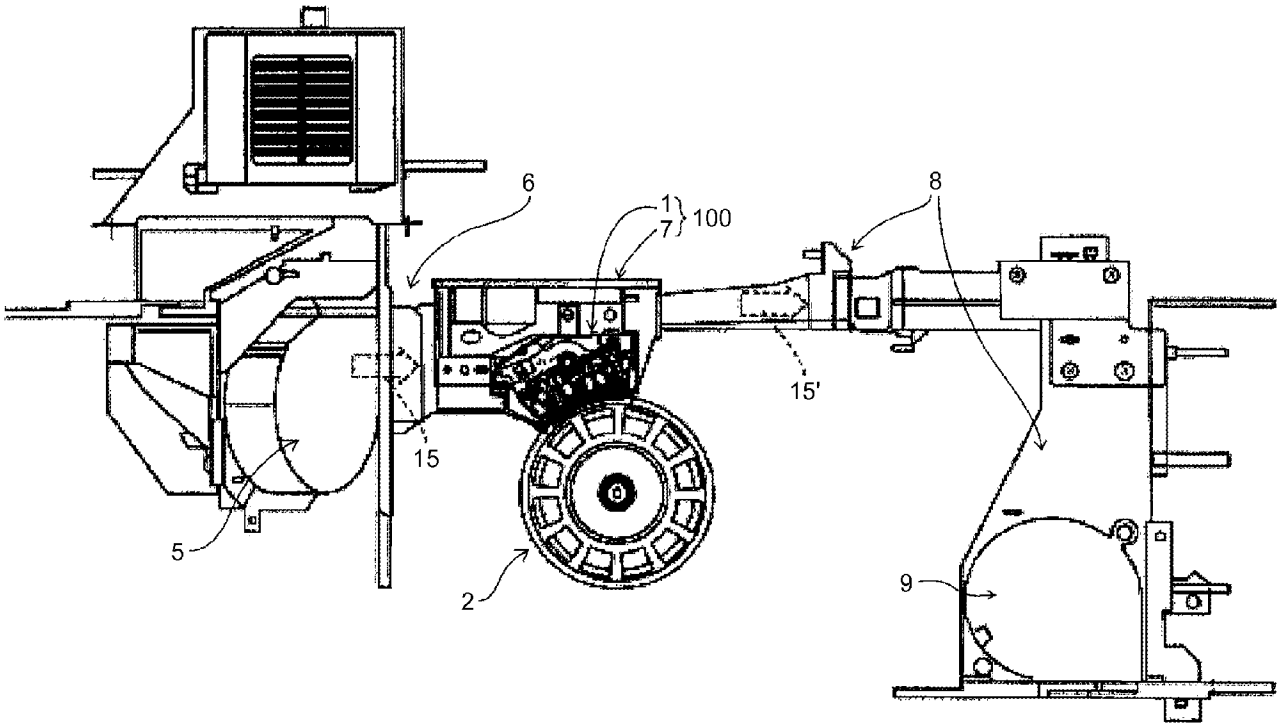
FIG. 4 is a perspective view of the main parts illustrating the duct path including the intake/exhaust fans and a charging duct arranged in the charging device.

With reference to FIG. 3 and FIG. 4, an intake and exhaust path around the charging device 100 will be described. FIG. 3 is a rear view of main parts of the image forming apparatus illustrated in FIG. 2, including intake/exhaust fans and a duct path. FIG. 4 is a perspective view of the main parts illustrating the duct path including the intake/exhaust fans and the charging duct arranged in the charging device.

In FIG. 3 and FIG. 4, a reference numeral 5 denotes an intake fan as an example of an intake unit that generates an intake airflow to be guided into the charging duct 7 arranged at the rear of the image forming apparatus body 50. The intake fan 5 is provided as a single unit, and communicates with/is connected to an intake fan duct 6 as an intake duct member to guide the generated intake airflow (hereinafter, may be simply referred to as the "airflow") to the charging duct 7.

The charging duct 7 communicates with/is connected to an exhaust fan duct 8 as an exhaust duct member. A single exhaust fan 9 as an example of an exhaust unit to exhaust the airflow (intake airflow) guided into the charging duct 7 is arranged at the most downstream side of the exhaust fan duct 8.

An intake airflow 15 generated by the operation of the intake fan 5 is guided into the charging duct 7 through the intake fan duct 6. The intake airflow 15 guided into the charging duct 7 becomes an exhaust airflow 15' by the operation of the exhaust fan 9, and the exhaust airflow 15' is discharged/exhausted to the outside of the image forming apparatus body 50 through the exhaust fan duct 8. In the exhaust fan duct 8, a filter for removing ozone or the like is appropriately arranged or disposed (which means "arranged and provided" or "positioned and provided, and the same applies hereinafter).

As the intake fan 5 and the exhaust fan 9, sirocco fans are used, in which pulse width modulation (PWM) is possible. Therefore, it is possible to freely change the flow velocities by changing current values to the intake fan 5 and the exhaust fan 9.

Figure 5:
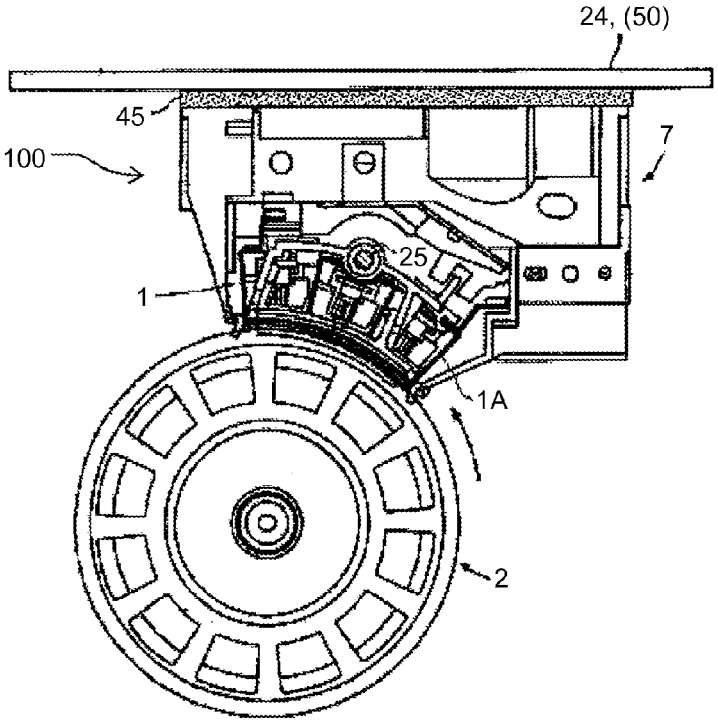
FIG. 5 is a partial cross-sectional view illustrating layout arrangement at the front of the charging device with a photoconductor drum in the center.

With reference to FIG. 5, layout arrangement and configurations of the charging device 100 and the photoconductor drum 2 will be described. FIG. 5 is a partial cross-sectional view illustrating layout arrangement at the front of the charging device 100 with the photoconductor drum 2 in the center.

The charging device 100 of the embodiment mainly includes the charging duct 7 as described above, and the electric charger 1 that is arranged in the charging duct 7 and that includes discharge wires 30 for charging the outer peripheral surface of the photoconductor drum 2.

The electric charger 1 is arranged in the vicinity above the photoconductor drum 2. The electric charger 1 is held at the charging duct 7. The charging duct 7 is arranged so as to surround the entire electric charger 1 from above, and has a role to divert and flow the intake airflow sent from the intake fan 5 to the electric charger 1.

The charging duct 7 is integrally formed with appropriate resin, has a portion formed of a plate being a thin metal plate, and is detachably attached to the image forming apparatus body 50. An upper portion of the charging duct 7 is attached in a state of being covered with a body metal plate 24 that is a thin plate-shape member arranged in the image forming apparatus body 50. In particular, a top panel of the laser writing device 52 illustrated in FIG. 2 (a bottom wall portion of the laser writing device 52) is used as the body metal plate 24.

A portion where sealing property is needed to assemble the charging duct 7 and the body metal plate 24 is sealed by attaching a gap seal 46 made of a sealing member, such as polyurethane, thereto with a double-stick tape.

The electric charger 1 is configured to be detachably attached to the charging duct 7. Specifically, in FIGS. 9A and 9B to be described later, held portions 28*a* and 28*b* of a charger body 1A are held by holders 26*a* and 26*b* of the charging duct 7 such that the electric charger 1 is detachably attached to the charging duct 7 in the longitudinal direction of the discharge wires 30 (a direction normal to the sheet of the figures). Therefore, it is possible to easily pull out the electric charger 1 from the charging duct 7 to perform operation of replacement, maintenance, cleaning, and the like on the electric charger 1.

A cleaning pad (not illustrated) as a pad-shaped cleaning member is movably arranged on a feed screw 25, which extends along the longitudinal direction of the discharge wires 30 as illustrated in FIG. 5, to clean the surfaces of the discharge wires in order to remove attached substances, such as toner, attached to the discharge wires 30. The cleaning pad is provided so as to be able to move back and forth in the longitudinal direction of the feed screw 25 while coming in sliding contact with the surfaces of the discharge wires, and cleaning is performed by rubbing the surfaces of the discharge wires by the cleaning pad. In this manner, by removing the attached substances, such as toner, attached to the surfaces of the discharge wires, it is possible to prevent a non-uniform discharge.

Figure 6A:
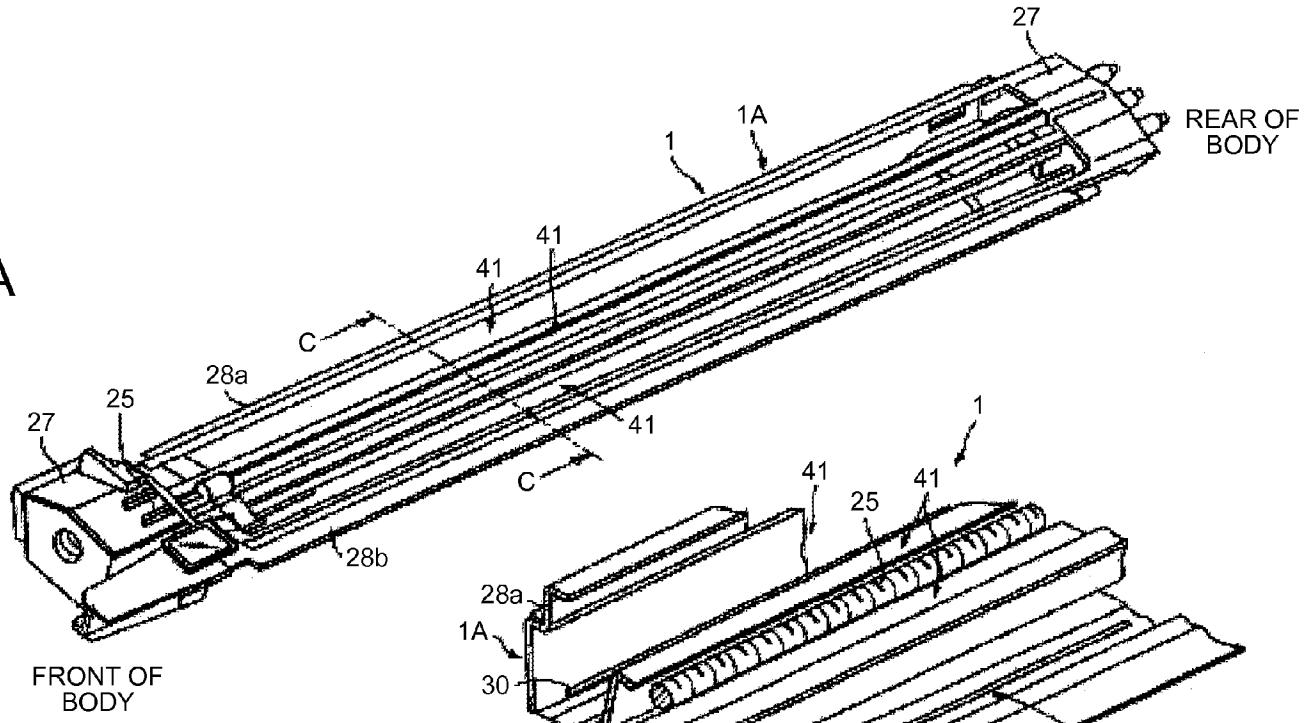
FIGS. 6A and 6B are perspective views of an electric charger viewed from diagonally above.
Figure 6B:
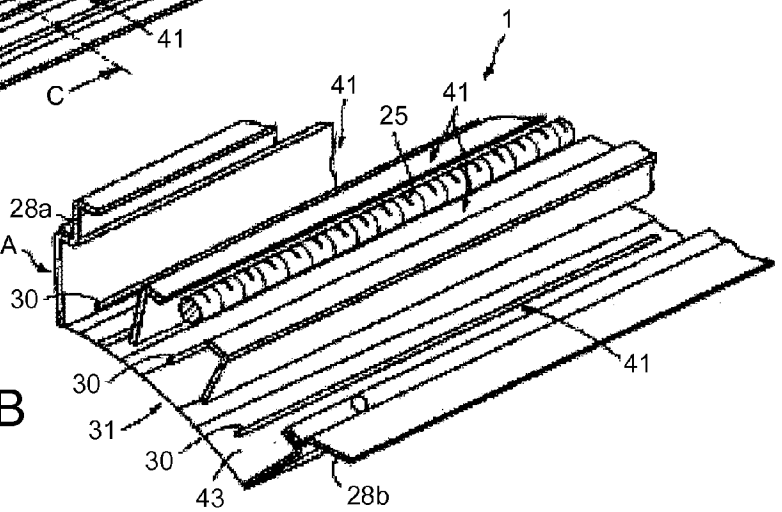

With reference to FIGS. 6A and 6B, a detailed configuration of the electric charger 1 will be described. FIGS. 6A and 6B are perspective views of the electric charger 1 viewed from diagonally above.

As illustrated in FIGS. 6A and 6B, the electric charger 1 is a scorotron charger including the charger body 1A, the discharge wires 30, a grid electrode 43, and insulating supporting members 27. The charger body 1A is provided along the longitudinal direction of the discharge wires 30 so as to partition the discharge wires 30 from each other. The discharge wires 30 function as an example of a discharge electrode that uniformly charges the surface of the photoconductor drum 2, and a plurality of the discharge wires 30 (three in the embodiment) are arranged.

Both end portions of the charger body 1A are supported and fixed by the insulating supporting members 27. End portions of the discharge wires 30 are engaged with and fixed by power supply terminals (not illustrated) provided in the insulating supporting members 27. A high-voltage power supply (not illustrated) applies a high voltage to each of the discharge wires 30 via the power supply terminals (not illustrated). Meanwhile, the electric charger 1 may be referred to as a charging device.

The grid electrode 43 is formed into a mesh of stainless steel with a thickness of 0.1 mm, and functions as a discharge current control member. Specifically, the grid electrode 43 has a function to equalize a discharge from the discharge wires 30 and to charge the outer surface of the photoconductor drum 2. The grid electrode 43 is formed into a curve with a predetermined space from the outer surface of the photoconductor drum 2, and integrally attached to a lower portion of the charger body 1A that partitions the lower side of the discharge wires 30.

Opening holes 41 are formed at the upper of the charger body 1A that partitions the lower of the discharge wires 30. An opening 31 is formed at the lower of the charger body 1A with the mesh-shaped grid electrode 43 through which airflow passes. Specifically, the opening holes 41 formed at the upper of the charger body 1A communicate with the mesh-shaped grid electrode 43 attached to the lower of the charger body 1A.

Figure 7:
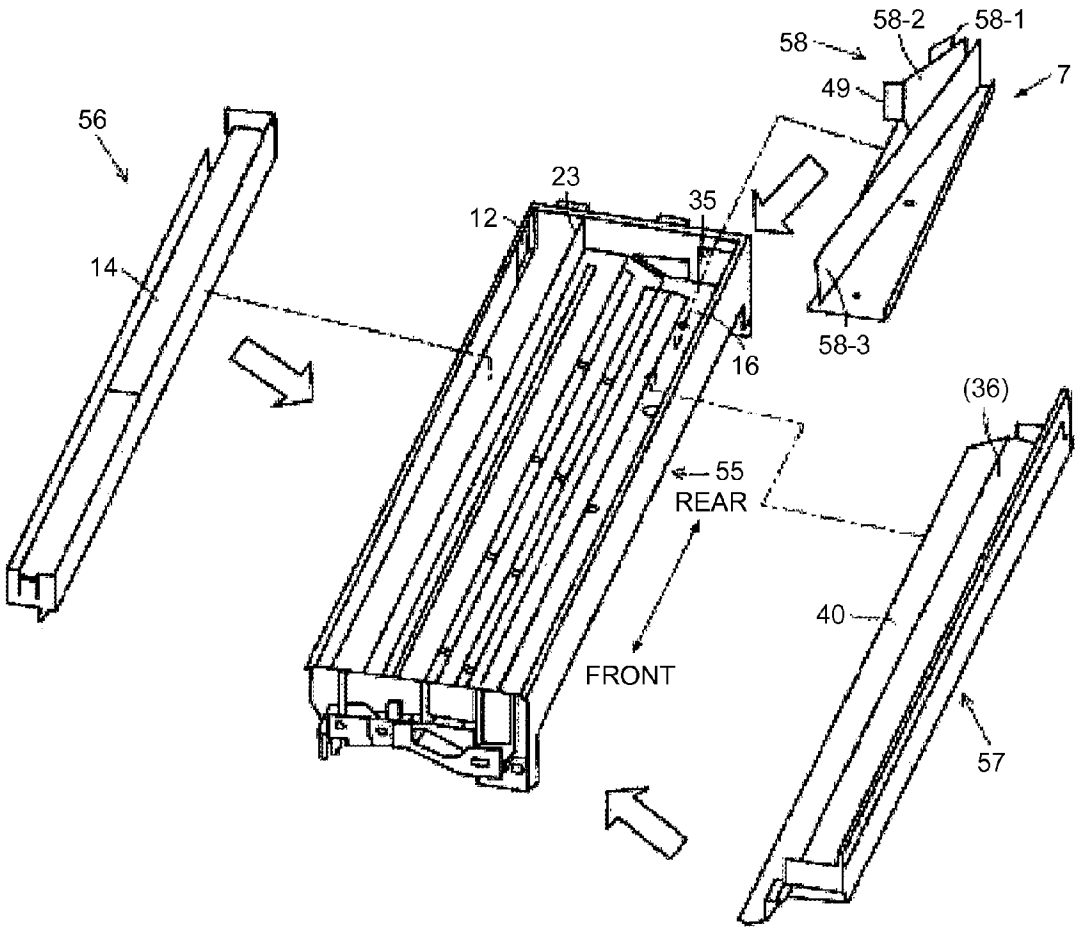
FIG. 7 is an exploded perspective view of components of the charging duct.

With reference to FIG. 7, components of the charging duct 7 will be described. FIG. 7 is an exploded perspective view of the components of the charging duct 7. As illustrated in FIG. 7, the charging duct 7 includes four components of a duct body 55 for housing three components to be described later, an exhaust duct 56, an intake duct 57, and a partition plate 58.

In the charging duct 7, a first guide plate 48 is integrally formed in the duct body 55 close to a lower airflow path 36. The partition plate 58 including three sheet-metal partition plates 58-1, 58-2, and 58-3 is provided in an upper airflow path 37 (illustrated with brackets) along the longitudinal direction of the charging duct 7. Further, a second guide plate 49 is provided on the partition plate 58-2 to improve the balance of a flow velocity and prevent backflow.

Figure 8:
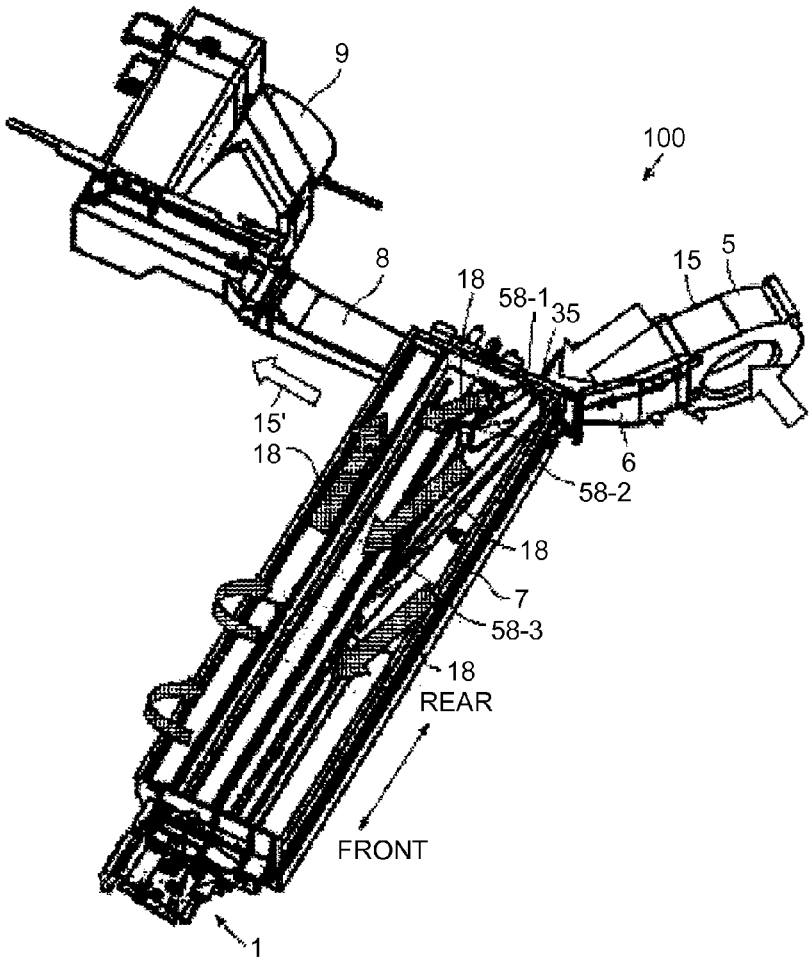
FIG. 8 is a perspective view for explaining an airflow flowing through an upper airflow path in the charging device.
Figure 9B:
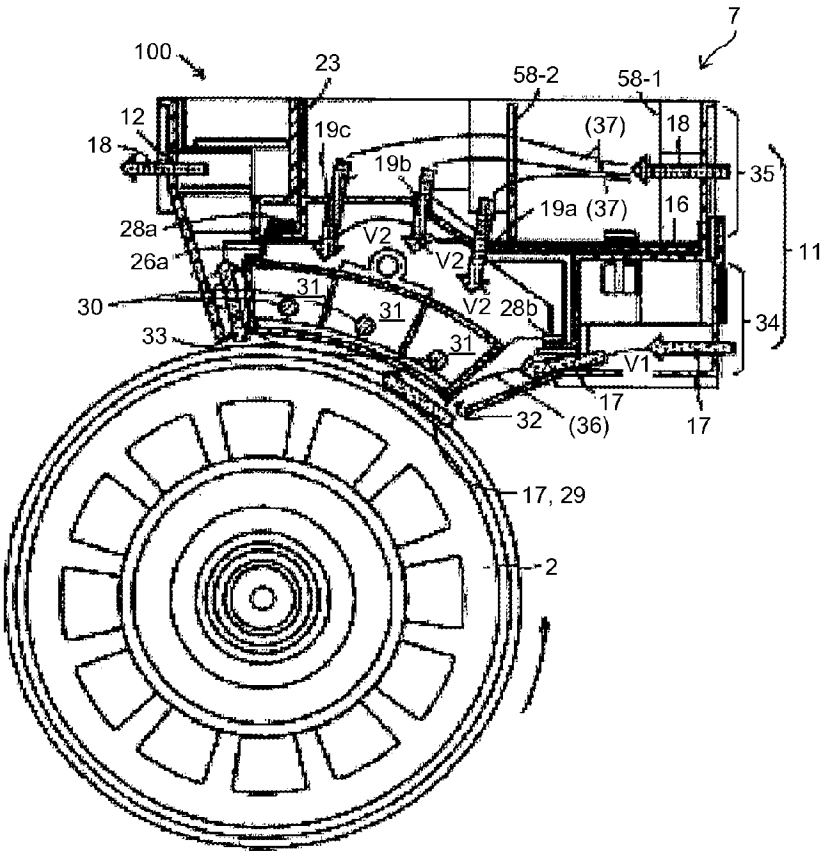
FIG. 9B is a cross-sectional view illustrating the shape of a C-C cross section in FIG. 9A and the flows of airflows.
Figure 9A:
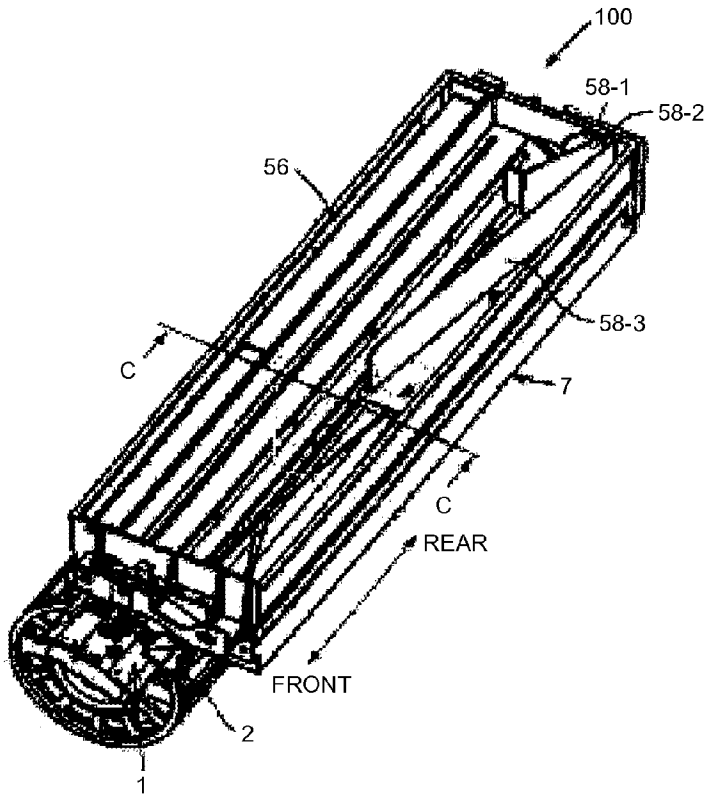
FIG. 9A is a perspective view of the charging device and the charging duct viewed from the front.

With reference to FIGS. 8, 9A, and 9B, airflow paths and flows of airflows in the charging device 100 will be described.

FIG. 8 is a perspective view for explaining an airflow flowing through the upper airflow path 37 in the charging device 100. In FIG. 8, the charging duct 7 in which the body metal plate 24 illustrated in FIG. 5 is omitted. FIG. 9A is a perspective view of the charging device 100 and the charging duct 7 viewed from the front. FIG. 9B is a cross-sectional view illustrating the shape of a C-C cross section in FIG. 9A and the flows of airflows.

As illustrated in FIGS. 8, 9A, and 9B, the intake airflow 15 generated by the operation of the intake fan 5 is guided into a charging duct 7A through the intake fan duct 6. The airflow guided into an intake port 11 of the charging duct 7A is diverted, by two divided ports of a lower intake port 34 and an upper intake port 35, into an airflow 17 that passes through the lower airflow path 36 and that forms an airflow wall (air barrier) 29, and an airflow 18 that is sent to the discharge wires 30 through the upper airflow path 37. At this time, the airflow 18 is sent while being prevented from flowing backward by an intake hole 20.

A flow velocity V1 of the airflow 17 sent out from the lower intake port 34 increases due to a difference between duct heights h1 and h2 of the lower airflow path 36, that is, a difference between the sectional areas. Further, the airflow 17 sent out from an intake exit 32 forms the airflow wall (air barrier) 29 that covers the entire opening 31 from the intake exit 32 at the upstream end in the rotation direction of the photoconductor drum (counterclockwise in FIGS. 9A and 9B) at the opening 31, to an exhaust entry 33 at the downstream end. The airflows 17 form similar flows in the longitudinal direction of the charging duct 7.

In contrast, a flow velocity V2 of the airflow 18 (smaller than the flow velocity V1 of the airflow 17) sent out from the upper intake port 35 increases by inclination of a partition plate 16 of the upper airflow path 37. Therefore, the airflow 18 is distributed in the longitudinal direction of the discharge wires 30 in accordance with the above-described settings of widths of intake entries of the partition plates 58-1, 58-2, and 58-3 and slit holes 19*a*, 19*b*, and 19*c*. The airflows 18 form similar flows in the longitudinal direction of the charging duct 7.

As illustrated in FIGS. 9A and 9B, the charging duct 7 is configured to surround the entire opening 31 of the charger body 1A excluding an opposed opening facing the surface of the photoconductor drum 2, in the opening 31 of the charger body 1A, and to be able to introduce and exhaust the intake airflow within the surrounded area. The charging duct 7 includes an airflow wall forming unit (air barrier forming unit) that covers, with the airflow wall (air barrier) 29 of the airflow 17, the entire opening 31 from the upstream end to the downstream end in the rotation direction of the photoconductor drum (counterclockwise in FIGS. 9A and 9B) at the opening 31 of the charger body 1A.

The airflow wall forming unit includes the intake exit 32 formed between the charger body 1A and the charging duct 7 at the upstream end in the rotation direction of the photoconductor drum (counterclockwise in FIGS. 6A and 6B) at the opening 31, and the exhaust entry 33 formed between the charger body 1A and the charging duct 7 at the downstream end.

The intake exit 32 and the exhaust entry 33 are formed along the longitudinal direction of the discharge wires 30 and the opening 31.

The intake port 11 being an entry of the intake airflow of the charging duct 7 is divided, by the partition plate 16, into two ports of the lower intake port 34 as a first intake port and the upper intake port 35 as a second intake port. The airflow 17 (hereinafter, also referred to as the "airflow 17") as a part of the intake airflow 15 generated by the intake fan 5 illustrated in FIG. 3 is sent into the lower intake port 34, and the airflow 18 as a part of the intake airflow 15 generated by the intake fan 5 illustrated in FIG. 3 is sent into the upper intake port 35. The lower intake port 34 and the upper intake port 35 communicate with respective independent airflow paths independently formed in the charging duct 7.

The upper portion of the partition plate 16 of the charging duct 7 is partitioned by a plurality of (three in the embodiment) the partition plates 58-1, 58-2, and 58-3. The three partition plates 58-1, 58-2, and 58-3 are provided to split the airflow 18 sent from the upper intake port 35 so as to uniformly distribute the airflow 18 in the longitudinal direction of the discharge wires 30.

A center wall 23 partitions the charging duct 7 into an intake area and an exhaust area. Further, the exhaust area is partitioned by a partition plate 14.

As illustrated in FIG. 5 for example, the upper portion of the charging duct 7 is closely attached to the body metal plate 24, and serves as a cover (lid). It may be possible to provide a dedicated cover at the upper portion of the charging duct 7; however, the body metal plate 24 is used in the embodiment in order to ensure space for layout and prevent an increase in cost. The attachment surface of the body metal plate 24 is sealed to prevent leakage of airflow.

As described above, the charging duct 7 is substantially sealed, excluding the intake port 11, the intake exit 32, and the exhaust entry 33.

In FIG. 9A, as indicated by the flow of the airflow 17, the lower intake port 34 communicates with the lower airflow path 36 illustrated with brackets in FIG. 9A, as one of the independent airflow paths (or a first independent airflow path) independently formed in the charging duct 7. Specifically, the lower airflow path 36 is formed by a path from the lower intake port 34 to an exhaust port 12 through an opening hole 38 formed on a lower duct wall, the intake exit 32, the airflow wall 29, and the exhaust entry 33. The lower airflow path 36 is arranged close to the surface of the photoconductor drum 2 to form the airflow wall 29.

The lower airflow path 36 is formed by using an outer wall surface 39 of the charger body 1A and an inner wall surface 40 of the charging duct 7. The outer wall surface 39 of the charger body 1A and the inner wall surface 40 of the charging duct 7 are provided so as to be inclined at an obtuse angle with respect to the surface of the photoconductor drum 2 in order to infallibly form the airflow wall 29.

In FIG. 9A, as indicated by the flow of the airflow 18, the upper intake port 35 communicates with the upper airflow path 37 illustrated with brackets in FIG. 9A, as the other independent airflow path (or a second independent airflow path) independently formed in the charging duct 7. Specifically, the upper airflow path 37 is formed by a path that starts from the upper intake port 35, is split and introduced by the partition plates 58-1, 58-2, and 58-3, passes through the slit holes 19*a*, 19*b*, and 19*c* formed in an upper duct, passes through the opening holes 41 formed in an upper wall of the charger body 1A, merges with the airflow wall 29, and leads to the exhaust port 12 from the exhaust entry 33.

In FIG. 9A, the magnitude of the flow velocity V1 of the airflow 17 flowing through the lower airflow path 36 is set to be greater than the flow velocity V2 of the airflow 18 flowing through the upper airflow path 37. It is sufficient that the flow velocity V2 of the airflow 18 is set such that a minimum airflow that can remove ozone generated by the discharge wires 30 is ensured. In contrast, it is necessary to increase the flow velocity of the airflow 17 in order to prevent foreign objects, such as paper powder carried from the cleaning device 60 or the like due to the rotation of the photoconductor drum 2, or scattered toner from the developing device 3, from entering the charger body 1A from the outside.

With reference to FIGS. 9A and 9B, behavior of the airflows 17 and 18 with the above-described configuration of the charging duct 7 will be described.

The flow velocity V1 of the airflow 17 sent out from the lower intake port 34 increases due to a difference between the duct heights h1 and h2 of the lower airflow path 36, that is, a difference between the sectional areas. Further, the airflow 17 sent out from the intake exit 32 forms the airflow wall (air barrier) 29 that covers the entire opening 31 from the intake exit 32 at the upstream end in the rotation direction of the photoconductor drum (counterclockwise in FIGS. 6A and 6B) at the opening 31 to the exhaust entry 33 at the downstream end.

In this case, foreign objects carried by a laminar flow (airflow along the surface of the photoconductor drum) or the like caused by the rotation of the photoconductor drum 2 or the like are blocked by the airflow wall (air barrier) 29, so that it is possible to prevent entry of the foreign objects from the outside. Examples of the foreign objects include toner and paper powder scattered from the cleaning device 60, zinc stearate to protect the surface of the photosensitive drum, and toner scattered from the developing device 3.

In contrast, the flow velocity V2 of the airflow 18 (smaller than the flow velocity V1 of the airflow 17) sent out from the upper intake port 35 increases by inclination of the partition plate 16 of the upper airflow path 37. Therefore, the airflow 18 is uniformly distributed in the longitudinal direction of the discharge wires 30 in accordance with the above-described settings of the widths of the intake entries of the partition plates 58-1, 58-2, and 58-3 and the slit holes 19*a*, 19*b*, and 19*c*.

From the above matters and FIGS. 9A and 9B, the passage sectional area of the lower airflow path 36 is smaller than the passage sectional area of the upper airflow path 37.

The flow velocity V1 of the airflow 17 forming the airflow wall 29 is higher than the flow velocity V2 of the airflow 18 to be sent to the discharge wires 30; therefore, negative pressure is generated by Bernoulli's principle from the airflow 18 to the airflow 17. Therefore, it is possible to use the airflow 18 to move ozone generated around the discharge wires 30 toward the photoconductor drum 2, and use the airflow 17 to prevent external foreign objects from attaching to the discharge wires 30.

Figure 10:
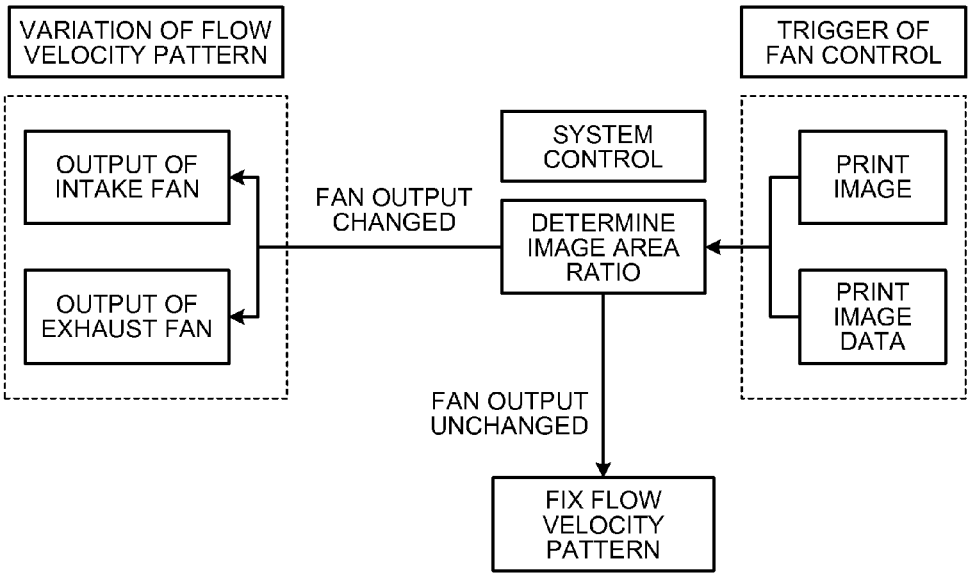
FIG. 10 is a diagram for explaining flow velocity control on the intake fan and the exhaust fan, which is performed according to an image area ratio determined based on image information.

In the image forming apparatus of the embodiment, it is possible to control the flow velocities of the airflow 18 and the airflow 17 in accordance with an image area ratio while a sheet of paper is being fed (at the time of image forming operation). FIG. 10 is a diagram for explaining flow velocity control on the intake fan 5 and the exhaust fan 9, which is performed according to an image area ratio determined based on image information.

As illustrated in FIG. 10, a control unit (not illustrated) provided in the image forming apparatus obtains an image area ratio on the basis of image information, such as print image data or a print image, read from an external apparatus, such as a personal computer. Then, the flow velocities of the airflows to be generated by the intake fan 5 and the exhaust fan 9 are changed in accordance with the obtained image area ratio. The airflow control to change the flow velocities of the airflows is performed by changing output values (PWM values) of the intake fan 5 and the exhaust fan 9.

For example, it is assumed that the flow velocity of an airflow generated when the image area ratio falls within a predetermined range set in advance is a first airflow velocity. In this case, if the image area ratio is higher than the predetermined range, the output values (PWM values) of the intake fan 5 and the exhaust fan 9 are changed such that a second airflow velocity higher than the first airflow velocity is reached.

Therefore, by increasing the flow velocity of the airflow as compared to the normal state, even when a large amount of toner is scattered, it is possible to efficiently discharge the scattered toner, prevent entry of the toner to the charging device 100, and reduce the amount of toner attached to the discharge wires 30. Consequently, it becomes possible to prevent an abnormal image from being formed due to a non-uniform discharge that may occur because of accumulation of toner on the discharge wires 30 with time.

If the amount of toner attached to the surfaces of the discharge wires 30 increases, the toner attached to the surfaces of the discharge wires and the cleaning pad rub against each other with repetitions of cleaning of the surfaces of the discharge wires by the cleaning pad, and the plating on the surfaces of the discharge wires may flake off. If the plating on the surfaces of the discharge wires flakes off, the charging capability is reduced and the lifetimes of the discharge wires 30 are reduced.

In contrast, when an image with a high image area ratio is formed, if the flow velocity of an airflow is increased as compared to the normal state, it becomes possible to reduce the amount of toner attached to the discharge wires 30, prevent the plating on the surfaces of the discharge wires from flaking off due to cleaning using the cleaning pad, and prevent a reduction in the lifetimes of the discharge wires 30.

As another case, when the image area ratio is lower than the predetermined range, the output values (PWM values) of the intake fan 5 and the exhaust fan 9 are changed such that a third airflow velocity lower than the first airflow velocity is reached. Therefore, it is possible to prevent the intake fan 5 and the exhaust fan 9 from rotating at a higher speed than needed, and to prevent occurrence of an extra noise.

Figure 11:
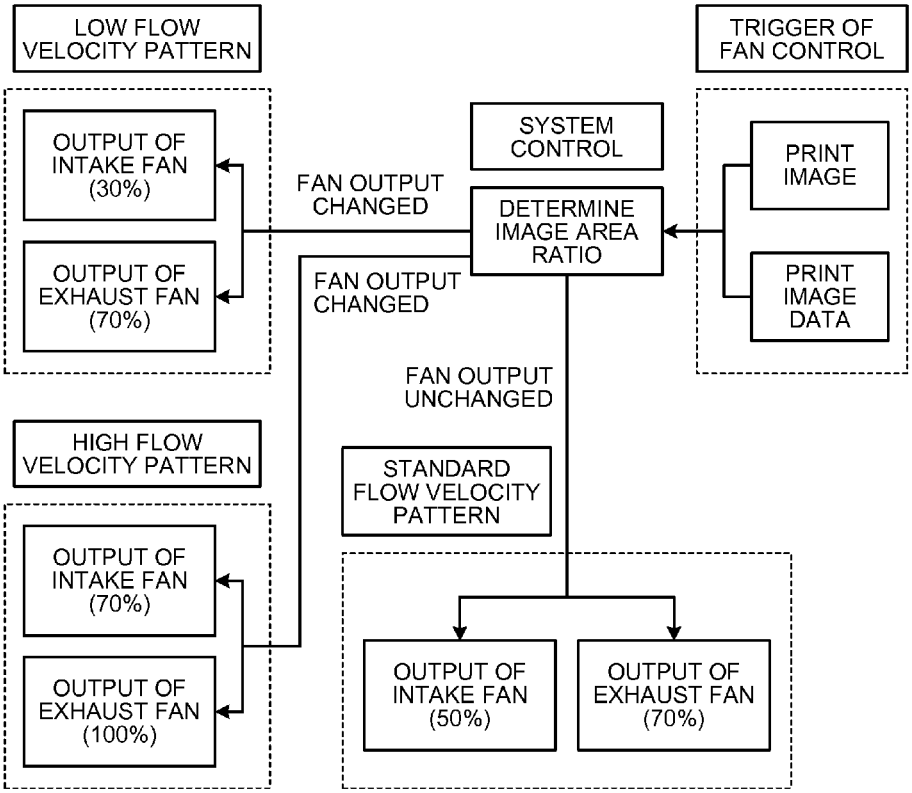
FIG. 11 is a diagram for explaining flow velocity control on the intake fan and the exhaust fan, which is performed by using a plurality of flow velocity patterns.

FIG. 11 is a diagram for explaining flow velocity control on the intake fan 5 and the exhaust fan 9, which is performed by using a plurality of flow velocity patterns. In this example, it is assumed that the output of each of the intake fan 5 and the exhaust fan 9 when the output values (PWM values) of the intake fan 5 and the exhaust fan 9 are maximum is assumed as 100%.

In the image forming apparatus of the embodiment, a plurality of flow velocity patterns for changing combination of the output values (PWM values) of the intake fan 5 and the exhaust fan 9 according to an image area ratio are used. For example, three flow velocity patterns of a standard flow velocity pattern, a low flow velocity pattern, and a high flow velocity pattern are set. The flow velocity patterns can freely be switched from one to another in accordance with the image area ratio. For example, the flow velocity pattern may be switched from the high flow velocity pattern to the low flow velocity pattern, from the low flow velocity pattern to the high flow velocity pattern, or from the low flow velocity pattern to the standard flow velocity pattern.

The standard flow velocity pattern is a flow velocity pattern that is employed when the image area ratio does not largely vary within a range of 5% to 7%. In the standard flow velocity pattern, the output of the intake fan 5 is set to 50%, and the output of the exhaust fan 9 is set to 70%.

The low flow velocity pattern is a flow velocity pattern that is employed when the image area ratio is lower than 5%. In the low flow velocity pattern, as compared to the standard flow velocity pattern, the output of the intake fan 5 is reduced from 50% to 30%, and the output of the exhaust fan 9 is maintained at 70%.

The high flow velocity pattern is a flow velocity pattern that is employed when the image area ratio is higher than 7%. In the high flow velocity pattern, as compared to the standard flow velocity pattern, the output of the intake fan 5 is increased from 50% to 70%, and the output of the exhaust fan 9 is increased from 70% to 100%. Therefore, the flow velocities of the entire airflows are increased, and entry of foreign objects (toner) to the charging device 100 is prevented.

As described above, by using a plurality of the flow velocity patterns, it becomes possible to optimize the flow velocity of an airflow in accordance with the image area ratio. Therefore, it is possible to appropriately set a current value to rotate the intake fan 5 and the exhaust fan 9 without any waste, and to realize energy savings.

Further, by obtaining the image area ratio from the image information, it becomes possible to freely change the flow velocity of an airflow while a sheet of paper is being fed (at the time of image forming operation). Furthermore, even when the image area ratio is changed during continuous image forming operation of successively forming images on a plurality of sheets S, it is possible to deal with a change in the flow velocity of an airflow in accordance with the image area ratio.

Information on the image area ratio to control the flow velocities of the airflows generated by the intake fan 5 and the exhaust fan 9 is not limited to the image information, such as a print image or print image data. For example, a detection result of a toner density of the developer contained in the developing device 3, which is detected by a toner density detection sensor (not illustrated) provided in the developing device 3, may be used as the information on the image area ratio.

Figure 12:
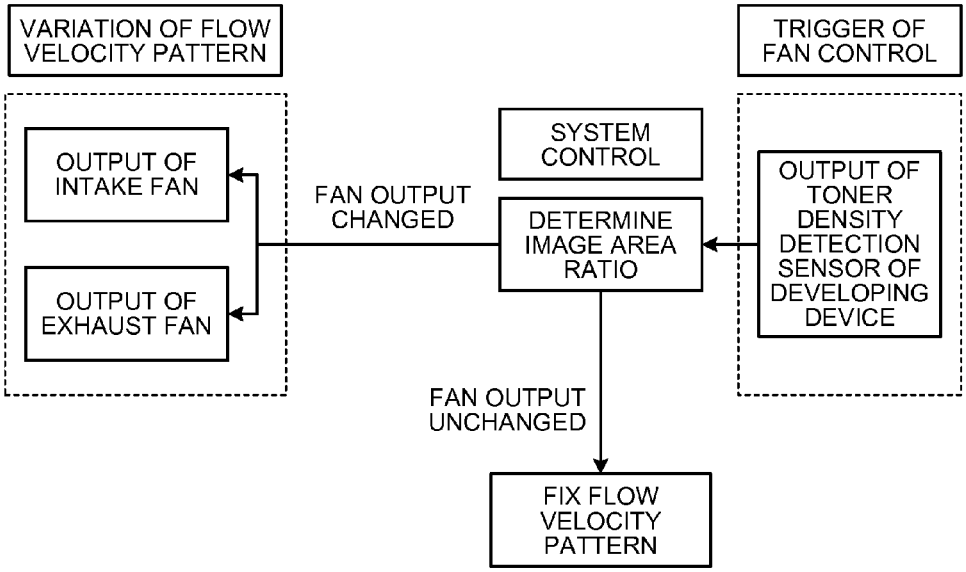
FIG. 12 is a diagram for explaining flow velocity control on the intake fan and the exhaust fan, which is performed according to an image area ratio determined based on a detection result of a toner density detection sensor.

FIG. 12 is a diagram for explaining flow velocity control on the intake fan 5 and the exhaust fan 9, which is performed according to an image area ratio determined based on a detection result of the toner density detection sensor provided in the developing device 3.

When an image with a high image area ratio is formed, the consumption of the toner of the developer contained in the developing device 3 is large, and the toner density in the developing device 3 is largely reduced, so that the amount of toner supplied to the developing device 3 from the toner replenishing device 77 increases.

Therefore, when it is determined that the toner density is largely reduced relative to a predetermined density set in advance on the basis of the detection result of the toner density detection sensor, and the amount of toner supplied to the developing device 3 is greater than a predetermined amount set in advance, it is determined that an image with a high image area ratio is formed. Then, the outputs of the intake fan 5 and the exhaust fan 9 are increased as compared to the normal state. For example, the outputs of the intake fan 5 and the exhaust fan 9 are changed from the fan outputs of the standard flow velocity pattern to the fan outputs of the high flow velocity pattern as described above.

In contrast, when an image with a low image area ratio is formed, the consumption of the toner of the developer contained in the developing device 3 is small, and the degree of reduction in the toner density in the developing device 3 is small, so that almost no toner is supplied to the developing device 3 from the toner replenishing device 77.

Therefore, when it is determined that the toner density is not much reduced relative to the predetermined density on the basis of the detection result of the toner density detection sensor, and the amount of toner supplied to the developing device 3 is smaller than the predetermined amount, it is determined that an image with a low image area ratio is formed. Then, the outputs of the intake fan 5 and the exhaust fan 9 are reduced to the minimum. For example, the outputs of the intake fan 5 and the exhaust fan 9 are changed form the fan outputs of the standard flow velocity pattern to the fan outputs of the low flow velocity pattern as described above.

In this manner, even by obtaining the image area ratio from the toner density of the developer contained in the developing device 3, it becomes possible to freely change the flow velocity of an airflow while a sheet of paper is being fed (at the time of image forming operation). Further, even when the image area ratio is changed during continuous image forming operation of successively forming images on a plurality of sheets, it is possible to deal with a change in the flow velocity of an airflow in accordance with the image area ratio.

Figure 1:
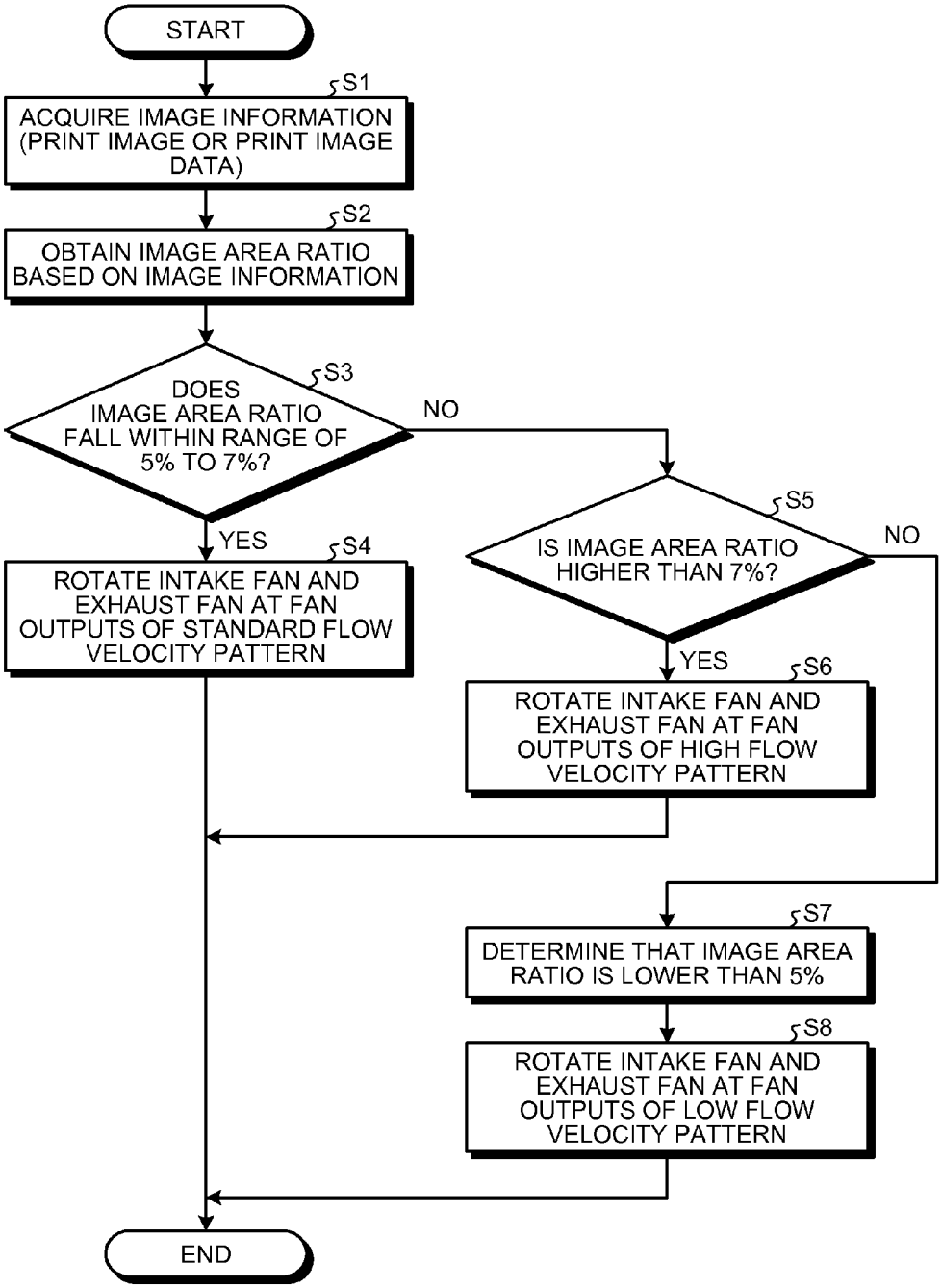
FIG. 1 is a flowchart illustrating an example of controlling flow velocities of an intake fan and an exhaust fan.

Next, an example of the flow velocity control on the intake fan 5 and the exhaust fan 9 will be described with reference to FIG. 1.

First, image information, such as a print image or print image data, is acquired (S1), and an image area ratio is obtained based on the image information (S2). Then, it is determined whether the obtained image area ratio falls within a range of 5% to 7% (S3). If the image area ratio falls within the range of 5% to 7% (YES at S3), the intake fan 5 and the exhaust fan 9 are rotated at the fan outputs of the standard flow velocity pattern as described above (S4).

In contrast, if the image area ratio does not fall within the range of 5% to 7% (NO at S3), it is determined whether the image area ratio is higher than 7% (S5). If the image area ratio is higher than 7% (YES at S5), the intake fan 5 and the exhaust fan 9 are rotated at the fan outputs of the high flow velocity pattern as described above (S6).

If the image area ratio is not higher than 7% (NO at S5), it is determined that the image area ratio is lower than 5% (S7), and the intake fan 5 and the exhaust fan 9 are rotated at the fan outputs of the low flow velocity pattern as described above (S8).

As described above, in the image forming apparatus of the embodiment, an example has been described in which a charging device of a corona charging system using a discharge wire or the like as a discharging member is employed. However, the disclosed technique is applicable to even a charging device of a non-contact roller charging system using a charging roller as the discharging member.

Specifically, by using a discharge of the charging roller arranged in the vicinity of the photoconductor drum with a small gap interposed therebetween, the flow velocities of the airflows generated by the intake fan 5 and the exhaust fan 9 are changed in accordance with the image area ratio such that the airflows pass through the charging device that charges the surface of the photoconductor as described above. Therefore, it is possible to prevent toner from accumulating on the surface of the charging roller with time, and prevent an abnormal image from being formed due to occurrence of a non-uniform discharge.

The above-described embodiment is a mere example. According to the following aspects of the disclosed technique, specific advantageous effects can be obtained.

(Aspect A)

An image forming apparatus includes: an image bearer, such as the photoconductor drum 2; a charging unit, such as the charging device 100, configured to charge a surface of the image bearer by causing a discharging member, such as the discharge wires 30, to discharge; a latent image forming unit, such as the laser writing device 52, configured to form a latent image on the surface of the image bearer charged by the charging unit; a developing unit, such as the developing device 3, configured to develop the latent image formed on the surface of the image bearer into a toner image with developer containing toner; an airflow generating unit, such as the intake fan 5 and the exhaust fan 9, configured to generate an airflow inside the image forming apparatus such that the airflow passes through at least the charging unit; an image-area-ratio information acquiring unit configured to acquire information on an image area ratio of the toner image; and a control unit configured to control the airflow generating unit so as to change a flow velocity of the airflow in accordance with the image area ratio.

In (Aspect A), the flow velocity of the airflow generated by the airflow generating unit is changed according to the image area ratio. Therefore, when a toner image with a high image area ratio that may cause a large amount of toner to be scattered is generated on the surface of the image bearer, it is possible to efficiently discharge the scattered toner from the charging unit by increasing the flow velocity of the airflow as compared to the normal state. Consequently, it is possible to reduce the amount of toner attached to the discharging member of the charging unit, and prevent an abnormal image from being formed due to a non-uniform discharge that may occur because of accumulation of toner on the discharging member with time.

Further, because the flow velocity of the airflow is changed according to the image area ratio, it is possible to prevent occurrence of an extra noise, such as the operation sound of the airflow generating unit or the sound of the discharged airflow, by always increasing the flow velocity of the airflow independent of the image area ratio.

(Aspect B)

In (Aspect A), a cleaning unit, such as the cleaning device 60, configured to clean the surface of the image bearer is provided. Therefore, as described in the above embodiment, it is possible to appropriately discharge, by the airflow, scattered toner that has not been collected by the cleaning unit.

(Aspect C)

In (Aspect A) or (Aspect B), when the flow velocity of the airflow generated when the image area ratio falls within a predetermined range set in advance is a first airflow velocity, and if the image area ratio is higher than the predetermined range, the control unit controls the airflow generating unit such that a second airflow velocity higher than the first airflow velocity is reached. Therefore, as described in the above embodiment, even when a large amount of toner is scattered, it is possible to prevent entry of the toner to the charging unit and reduce the amount of toner attached to the discharging member.

(Aspect D)

In (Aspect C), when the image area ratio is lower than the predetermined range, the control unit controls the airflow generating unit such that a third airflow velocity lower than the first airflow velocity is reached. Therefore, as described in the above embodiment, it is possible to prevent occurrence of an extra noise.

(Aspect E)

In (Aspect A), (Aspect B), (Aspect C), or (Aspect D), the information acquired by the image-area-ratio information acquiring unit is image information of the toner image, and the image area ratio is obtained based on the image information. Therefore, by obtaining the image area ratio from the image information, it is possible to freely change the flow velocity of the airflow while a sheet of paper is being fed (at the time of image forming operation). Further, even when the image area ratio is changed during continuous image forming operation of successively forming images on a plurality of sheets, it is possible to deal with a change in the flow velocity of the airflow in accordance with the image area ratio.

(Aspect F)

In (Aspect A), (Aspect B), (Aspect C), or (Aspect D), the information acquired by the image-area-ratio information acquiring unit is a toner density of the developer contained in the developing unit. Therefore, by obtaining the image area ratio from the toner density of the developer contained in the developing unit, it is possible to freely change the flow velocity of the airflow while a sheet of paper is being fed (at the time of image forming operation). Further, even when the image area ratio is changed during continuous image forming operation of successively forming images on a plurality of sheets, it is possible to deal with a change in the flow velocity of the airflow in accordance with the image area ratio.

(Aspect G)

In (Aspect A), (Aspect B), (Aspect C), (Aspect D), (Aspect E), or (Aspect F), the airflow generating unit includes an intake fan, such as the intake fan 5, and an exhaust fan, such as the exhaust fan 9, and a plurality of flow velocity patterns for changing combination of output of the intake fan and output of the exhaust fan according to the image area ratio in order to control the flow velocity are used. Therefore, as described in the above embodiment, it is possible to realize energy savings.

(Aspect H)

In (Aspect A), (Aspect B), (Aspect C), (Aspect D), (Aspect E), (Aspect F), or (Aspect G), the control unit controls the airflow generating unit so as to change the flow velocity of the airflow in accordance with the image area ratio during image forming operation. Therefore, as described in the above embodiment, it is possible to optimize the flow velocity of the airflow during the image forming operation in accordance with the image area ratio.

According to an embodiment of the present invention, it is possible to prevent occurrence of an extra noise, and prevent an abnormal image from being formed due to a non-uniform discharge.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image bearer;

a charging unit configured to charge a surface of the image bearer by causing a discharging member to discharge;

a latent image forming unit configured to form a latent image on the surface of the image bearer charged by the charging unit;

a developing unit configured to develop the latent image formed on the surface of the image bearer into a toner image with developer containing toner;

an airflow generating unit configured to generate an airflow inside the image forming apparatus such that the airflow passes through at least the charging unit;

an image-area-ratio information acquiring unit configured to acquire information on an image area ratio of the toner image; and a control unit configured to control the airflow generating unit so as to change a flow velocity of the airflow in accordance with the image area ratio.

2. The image forming apparatus according to claim 1, further comprising a cleaning unit configured to clean the surface of the image bearer.

3. The image forming apparatus according to claim 1, wherein when the flow velocity of the airflow generated when the image area ratio falls within a predetermined range set in advance is a first airflow velocity, and if the image area ratio is higher than the predetermined range, the control unit controls the airflow generating unit such that a second airflow velocity higher than the first airflow velocity is reached.

4. The image forming apparatus according to claim 3, wherein when the image area ratio is lower than the predetermined range, the control unit controls the airflow generating unit such that a third airflow velocity lower than the first airflow velocity is reached.

5. The image forming apparatus according to claim 1, wherein the information acquired by the image-area-ratio information acquiring unit is image information of the toner image, and the image area ratio is obtained based on the image information.

6. The image forming apparatus according to claim 1, wherein the information acquired by the image-area-ratio information acquiring unit is a toner density of the developer contained in the developing unit.

7. The image forming apparatus according to claim 1, wherein the airflow generating unit includes an intake fan and an exhaust fan, and a plurality of flow velocity patterns for changing combination of output of the intake fan and output of the exhaust fan according to the image area ratio in order to control the flow velocity are used.

8. The image forming apparatus according to claim 1, wherein the control unit controls the airflow generating unit so as to change the flow velocity of the airflow in accordance with the image area ratio during image forming operation.

* * * * *